US006824248B2

(12) United States Patent
Tsuchii

(10) Patent No.: US 6,824,248 B2
(45) Date of Patent: Nov. 30, 2004

(54) INK JET RECORDING HEAD

(75) Inventor: Ken Tsuchii, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 10/151,056

(22) Filed: May 21, 2002

(65) Prior Publication Data

US 2002/0175967 A1 Nov. 28, 2002

(30) Foreign Application Priority Data

May 22, 2001 (JP) ..... 2001-152969
May 9, 2002 (JP) ..... 2002-134521

(51) Int. Cl.[7] ..... B41J 2/04; B41J 2/015

(52) U.S. Cl. ..... 347/54; 347/20

(58) Field of Search ..... 347/20, 7, 6, 1, 347/5, 68–72, 63, 50, 26, 61, 44, 27, 54; 399/261; 361/700; 310/328–330; 29/890.1

(56) References Cited

U.S. PATENT DOCUMENTS 6,540,336 B2 * 4/2003 Kubota et al.

* cited by examiner

*Primary Examiner*—Raquel Yvette Gordon
(74) *Attorney, Agent, or Firm*—Fitzpatrick, Cella, Harper & Scinto

(57) ABSTRACT

An ink jet recording head includes a recording element base plate having an ink heating portion for heating ink, and ink discharge ports for discharging ink heated by the ink heating portion; a main body portion having an ink supply path for inducing ink from an ink retaining portion; and a connecting member having a first bonding surface bonded to the main body portion, and a second bonding surface bonded to the recording element base plate. For this head, the connecting member is formed by material having a weaker stretching strength than that of the recording element base plate. With the structure thus arranged, it is possible to provide an ink jet recording head capable of printing high-quality images at all times without deforming the recording element base plate due to the difference in the bonding temperature of the recording element base plate and room temperature, or due to temperature changes at the time of driving, even if the number of nozzles increases and the recording element base plate is made longer.

10 Claims, 7 Drawing Sheets

INK JET RECORDING HEAD

BACKGROUND OF THE INVENTION

1. Field of the Invention

The present invention relates to an ink jet recording head that obtains recorded images by discharging ink to the recording surface of a recording medium.

2. Related Background Art

There has been practically provided an ink jet recording apparatus that forms images by the adhesion of the ink on the recording surface of a recording medium, which is discharged selectively thereto from plural ink discharge ports in accordance with recording data. For the ink jet recording apparatus of the kind, the ink jet recording head, which is selectively mounted on a carriage, is provided and arranged to face the recording surface of the recording medium and scan in the direction orthogonal to the conveying direction of the recording medium.

As shown in FIG. 8, an ink jet recording head 16 of the so-called side shooter type comprises, for example, the main body portion 18 formed by an ink supply portion 18B having an ink tank IT installed thereon, and an input terminal portion 18A electrically connected with a carriage portion (not shown) to receive a driving control signal group form the carriage portion; a supporting member 20 connected with the joining face 18*b* of a recess 18BG of the ink supply portion 18B of the main body portion 18; a recording element base plate 24 bonded to the upper face that serves as a second bonding face of the supporting member 20; and a printed circuit board 22 electrically connected with the recording element base plate 24 to supply the driving control signal group from the input terminal portion 18A.

The input terminal portion 18A and ink supply portion 18B of the main body portion 18 are formed integrally by resin, for example. On the upper face of the ink supply portion 18B of the main body portion 18 opposite to the portion where the ink tank IT is installed, an almost rectangular recess 18BG is arranged as shown in FIG. 8 and FIGS. 9A and 9B. The bottom face of the recess 18BG is made to be the joining face 18*b* where the supporting member 20 is bonded. A part of the joining face 18*b* is formed by the surface of a block piece 26 of aluminum alloy, for example. The block piece 26 is arranged in a metallic die and surrounded by resin when the main body portion 18 is formed. Almost on the central portion of the joining face 18*b*, there opens the thin and long end portion of the ink supply path 18*a* that induces ink from the ink tank IT.

As shown in FIG. 10 and FIG. 11, the recording element base plate 24 comprises the base plate 10 having an ink supply port 10*c* communicated with the opening end portion of the ink supply path in the ink supply portion; partition wall members 12 that form plural ink branch supply paths 12*a* arranged corresponding to heaters 10*a* serving as the ink heating portion on the base plate 10; and an orifice plate 14 having plural ink discharge ports 14*a* arranged in two line formation corresponding to each of the heaters 10*a* on the base plate 10.

For the recording element base plate 24, a silicon thin film is formed in a thickness of 0.5 mm to 1.0 mm, for example. Also, as shown in FIG. 9A, the surface of the recess 18BG of the ink supply portion 18B of the base plate, which is bonded to the joining face 18*b* by the application of a bonding agent, is provided with the ink supply opening portion 24*c* facing the orifice plate, which is extended in the arrangement direction of the ink discharge ports 24*a*. Further, on both sides of the base plate having the ink supply opening portion 24*c* between them, heaters (not shown) are arranged with designated gaps between them, respectively. The ink supply opening portion 24*c* is communicated with one end portion of the ink branch supply paths provided for the partition wall members. Each of the ink branch supply paths induces to each heater the ink that is supplied through the ink supply opening portion 24*c*.

As shown in FIG. 8 and in FIGS. 9A and 9B, the printed circuit board 22 is electrically connected with each of the electrodes of the base plate for the recording element base plate 24. The printed circuit board 22 is provided with the containing portion 24B of the recording element base plate where the recording element base plate 24 is arranged, and a terminal portion 24A, which is arranged for the input terminal portion 18A of the main body portion 18. For the bonding of the printed circuit board 22 and the recording element base plate 24, the TAB (tape automated bonding) method is adopted, for example.

The supporting member 20, which is arranged between the recording element base plate 24 and the joining face 18*b* of the recess 18BG of the ink supply portion 18B, is formed to be flat and rectangular as shown in FIG. 8 and FIGS. 9A and 9B. Here, the same silicon material used for the recording element base plate 24 forms the supporting member 20, for example.

As shown in FIG. 9A, the supporting member 20 is provided with a second joining face 20Sa bonded to the surface arranged for the ink supply opening portion 24*c* of the recording element base plate 24, and a first joining face 20Sb bonded to the joining face 18*b* of the recess 18BG of the ink supply portion 18B. Also, the supporting member 20 is provided with a communication path 20*a*, which is extended to be thin and long in the longitudinal direction, in a position facing the ink supply path 18*a* arranged for the ink supply opening portion 24*c* of the recording element base plate 24 and the joining face 18*b* of the recess 18BG of the ink supply portion 18B. Further, the length of the shorter side and longer side of the supporting member 20 are the same as that of the shorter side and longer side of the recording element base plate 24, respectively, and the thickness of the supporting member 20 is substantially the same as that of the recording element base plate 24.

When arranging the recording element base plate 24 having the printed circuit board 22 connected therewith for the ink supply portion 18B, the first joint face 20Sb of the supporting member 20 is bonded, at first, to the designated position on the joining face 18*b* by use of bonding agent. Then, in continuation, as shown in FIG. 9B, the second joining face 20Sa of the supporting member 20 is bonded to the surface having the ink supply opening portion 24*c* arranged for the recording element base plate 24 by use of a bonding agent. Here, it is desirable to use a bonding agent having low viscosity and thin bonding layer to be formed on the contact face, and comparatively high hardness once cured.

With the structure thus arranged, when each of the heaters is heated on the base plate of the recording element base plate 24 with the supply of a heater driving control signal through the printed circuit board 22, ink is induced by way of the ink supply path 18*a* through the ink branch supply paths of the partition member. Then, ink is heated by each of the heaters to generate a bubble by means of a film boiling phenomenon, and along with the expansion of the bubble, ink is discharged from each of the ink discharge ports 24*a* toward the recording surface. However, there are the following problems encountered by the conventional example described above.

In other words, it is found that when the number of nozzles should increase and the length of the recording element base plate should be made larger still, the problems identified below occur sometimes irrespective of the case where the base plate is formed by the same silicon material used for the supporting member or formed by alumina or the like, the linear expansion coefficient of which is similar to that of silicon. Now, hereunder, the problems will be discussed more specifically in accordance with the properties of bonding agents used for bonding the supporting member and the recording element base plate.

(1) In a Case of a Thermal Curing Bonding Agent

When the recording element base plate and the supporting member are bonded by use of thermal curing bonding agent, the curing temperature is higher than the room temperature. In other words, the aluminum blocks of the main body portion, as well as the supporting base plate and the recording element base plate, are all bonded in a state of being expanded at a temperature higher than room temperature. Then, after bonding, as the temperature of recording head is lowered, each of the members is contracted. Generally, the linear expansion coefficient of the aluminum blocks is greater than that of the recording element base plate and the supporting base plate. Thus, the ratio of contraction thereof is greater when the temperature of the recording head is lowered. As a result, when the recording head returns to room temperature after bonding, the dimensional changes of the aluminum blocks are greater than those of the recording element base plate and the supporting base plate, hence generating stresses among the recording element base plate, supporting base plate, and the aluminum blocks. When the number of nozzles is small, and the length of the recording element base plate is small, the dimensional changes are also small when the temperature changes. The exertion of stresses is small accordingly. Therefore, if silicon or alumina is used for the supporting base plate, it is possible to minimize the amount of deformation of the recording element base plate because the use of such material can resist the occurrence of stresses. However, with the increase in nozzle numbers, the recording element base plate needs to become longer. Then, the difference between the dimensional changes of the recording element base plate, the supporting base plate, and the aluminum blocks becomes greater after curing, and the occurrence of stresses becomes greater accordingly. Consequently, even when silicon or alumina is used for the supporting base plate, it becomes difficult to resist the stresses thus exerted, and in some cases, the recording element base plate is deformed greatly. If such deformation takes place, the impact position of ink droplets from the recording head of an ink jet recording apparatus is caused to shift, resulting in the degradation of printed images or, further, the recording element base plate may be broken in some cases.

(2) In a Case of a Cold Curing Bonding Agent

When the cold curing bonding agent, which is cured at a temperature close to room temperature, is used for bonding the recording element base plate and the supporting member, there is no such problem as described above. However, if the temperature of the recording head rises during printing operation, the same problems take place. In other words, when the head temperature rises during the printing operation, the aluminum blocks, recording element base plate, and the supporting base plate are expanded, and the dimensions of each of them become larger. Particularly, the linear expansion coefficient of the aluminum blocks is greater than that of the recording element base plate and supporting base plate, and the dimensional changes are great. Thus, when the temperature rises, a difference in dimensional changes occurs between the aluminum blocks, and the recording element base plate and supporting base plate. As a result, stresses occur among the recording element base plate, supporting base plate, and aluminum blocks. When the number of nozzles is small, and the length of the recording element base plate is small, the dimensional changes are also small when the temperature changes. The exertion of stresses is small accordingly. Therefore, if silicon or alumina is used for the supporting base plate, it is possible to minimize the amount of deformation of the recording element base plate because the use of such material can resist the occurrence of stresses. However, with the increase in nozzle numbers, the recording element base plate needs to become longer. Then, the difference between the dimensional changes of the recording element base plate, the supporting base plate, and the aluminum blocks becomes greater after curing, and the occurrence of stresses becomes greater accordingly. Consequently, even when silicon or alumina is used for the supporting base plate, it becomes difficult to resist the stresses thus exerted, and in some cases, the recording element base plate is deformed greatly. If such deformation takes place, the impact position of ink droplets from the recording head of an ink jet recording apparatus is caused to shift, resulting in the degradation of printed images or, further, the recording element base plate may be broken in some cases. Now, therefore, the present invention is designed to solve the problems discussed above, and it aims at the provision of an ink jet recording head capable of printing high-quality images at all times without the deformation of the recording element base plate due to the difference between the temperature at which the recording element base plate is bonded and room temperature, or due to temperature changes at time of driving, especially when the recording element base plate is made longer due to an increase in the number of nozzles.

SUMMARY OF THE INVENTION

In order to solve the aforesaid problems, the present invention provides an ink jet recording head structured as described in paragraphs (1) to (10) given below.

(1) An ink jet recording head comprises:

a recording element base plate having an ink heating portion for heating ink, and ink discharge ports for discharging ink heated by the ink heating portion;

a main body portion having ink supply path for inducing ink from an ink retaining portion; and a connecting member having a first bonding surface bonded to the main body portion, and a second bonding surface bonded to the recording element base plate. For this head, the connecting member is formed by material having a weaker stretching strength than that of the recording element base plate.

(2) The ink jet recording head referred to in paragraph (1) for which the relationship between the connecting member and the recording element base plate is arranged to satisfy the following formula (i):

$$Es \cdot ts^3 \cdot ws > Ea \cdot ta^3 \cdot wa \quad \text{(i)}$$

where

Es: Young's modulus (dyn/cm$^2$) of the recording element base plate ts: thickness (cm) of the recording element base plate ws: width (cm) of the recording element base plate Ea: Young's modulus (dyn/cm$^2$) of the connecting member ta: thickness (cm) of the connecting member wa: width of the connecting member (cm)

(3) The ink jet recording head referred to in paragraph (1) or paragraph (2), for which the connecting member is formed from either a resin or a compound material of resin and metal.

(4) The ink jet recording head referred to in paragraph (1) or paragraph (2), for which the connecting member is formed from polyimide.

(5) The ink jet recording head referred to in any one of paragraphs (1) to (4), for which the connecting member is provided with electrode wiring for use in driving heat generating elements of the recording element base plate.

(6) The ink jet recording head referred to in any one of paragraphs (1) to (5), for which the connecting member is structured to laminate an electrode wiring with resin.

(7) The ink jet recording head referred to in any one of paragraphs (1) to (6), for which the recording element base plate and the main body portion are each provided with a portion for bonding the recording element base plate and the main body portion directly to each other.

(8) The ink jet recording head referred to in paragraph (7), for which the portions of direct bonding of the recording element base plate and the main body portion are arranged at plural locations.

(9) The ink jet recording head referred to in any one of paragraphs (1) to (10), for which the bonding center of the first bonding surface and the bonding center of the second bonding surface are arranged to shift in the horizontal direction.

(10) The ink jet recording head referred to in the paragraph (9), for which the bonding portions are arranged from a central area of the main body portion to a periphery thereof the following order: the area of in the direct bonding between the recording element base plate and the main body portion, the second bonding portion, and the first bonding portion.

With the adoption of the structure described above when embodying the present invention, the recording element base plate, which is arranged to obtain recorded images by discharging ink to a recording medium, is bonded and fixed to the main body, hence making it possible to provide an ink jet recording head capable of printing high-quality images at all times without deforming the recording element base plate due to the difference in the bonding temperature of the recording element base plate and the room temperature or due to the temperature changes at the time of driving, even if the number of nozzles increases and the recording element base plate is made longer.

DETAILED DESCRIPTION OF THE PREFERRED EMBODIMENTS

Hereinafter, the embodiments will be described in accordance with the present invention.

First Embodiment

Figure 1:
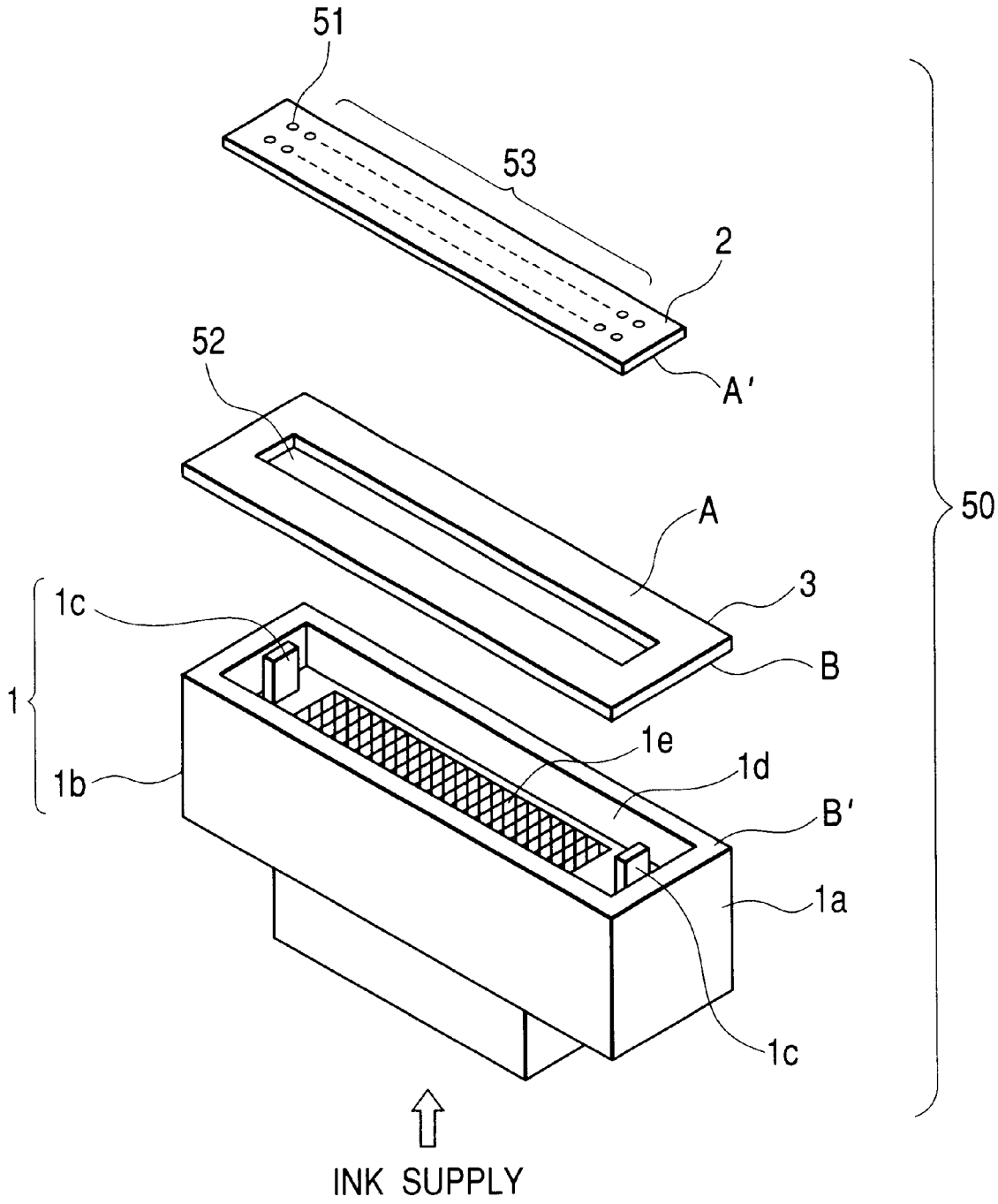
FIG. 1 is a view that shows the structure of an ink jet recording head in accordance with a first embodiment of the present invention.
Figure 2A:
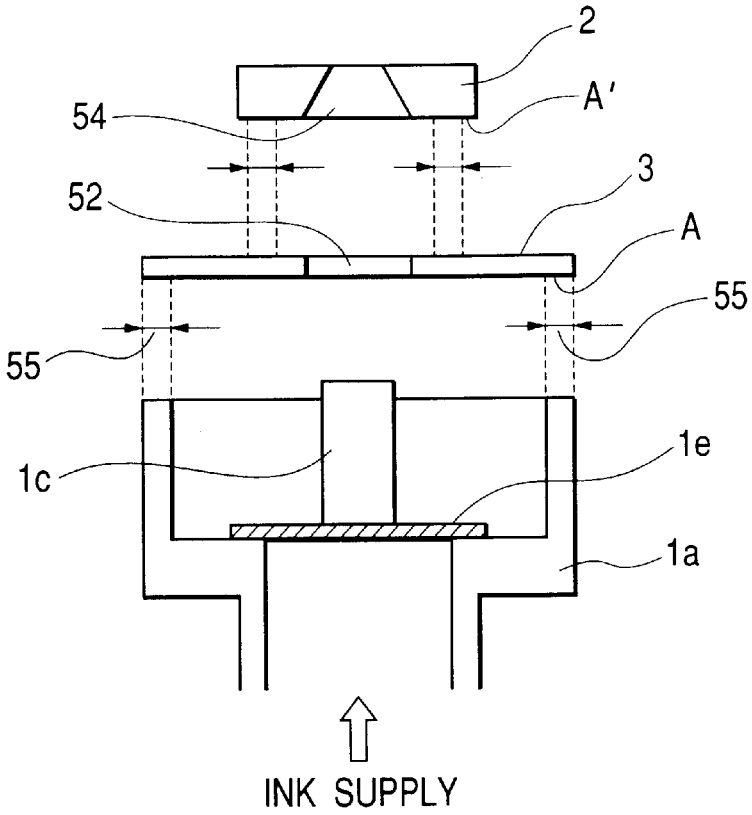
FIGS. 2A and 2B are views that illustrate the structure of the ink jet recording head in accordance with the first embodiment of the present invention.
Figure 2B:
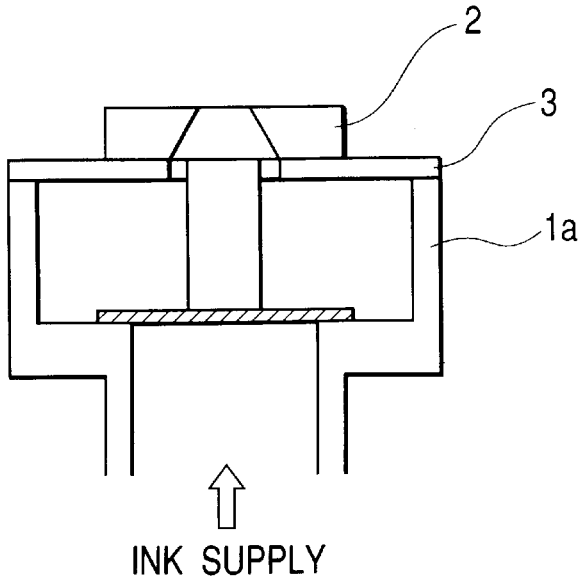

FIG. 1 and FIGS. 2A and 2B are views that illustrate the structure of an ink jet recording head 50 in accordance with a first embodiment of the present invention. FIG. 1 is a perspective view showing the ink jet head 50. FIGS. 2A and 2B are cross-sectional views schematically illustrating the ink jet head 50 represented in FIG. 1. In these figures, however, the flow paths provided for the recording element base plate, and the structure of the discharge port portion are omitted. Now, in conjunction with FIG. 1 and FIGS. 2A and 2B, the present embodiment will be described. Here, a reference numeral 1 designates the main body portion; 2, the recording element base plate that discharges ink from the discharge ports; and 3, the connecting member, which is bonded between the main body portion and the recording element base plate. These three constituents structure the ink jet recording head 50 of the present embodiment significantly.

In this respect, the main body portion 1 is provided with the ink supply portion 1*a* to which ink is supplied from an ink tank, and the input terminal portion 1*b* to which driving signal group is inputted from a carriage portion (not shown).

Figure 10:
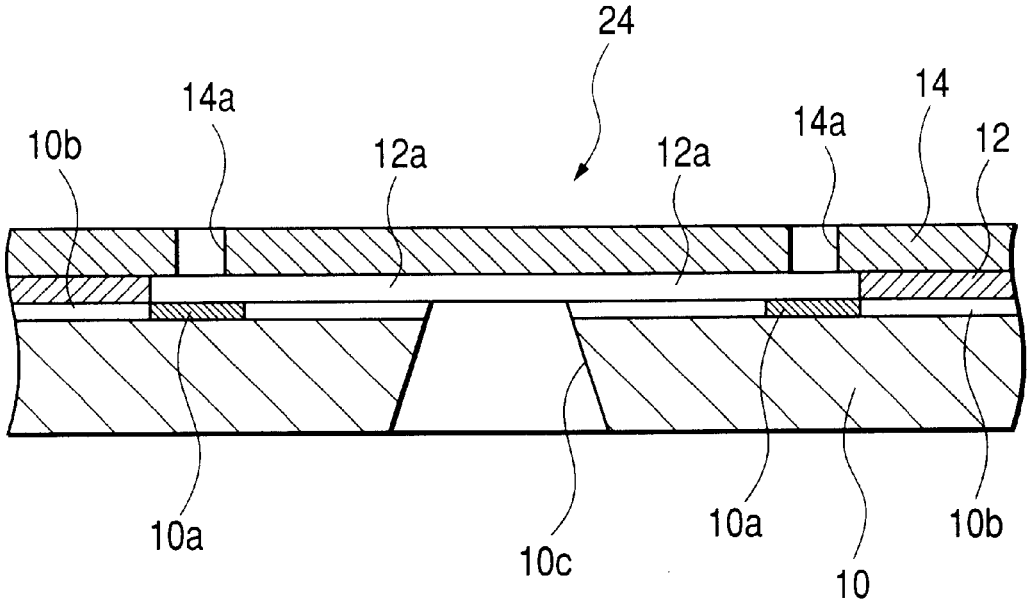
FIG. 10 is a view that shows the inner details of the conventional recording element base plate.
Figure 11:
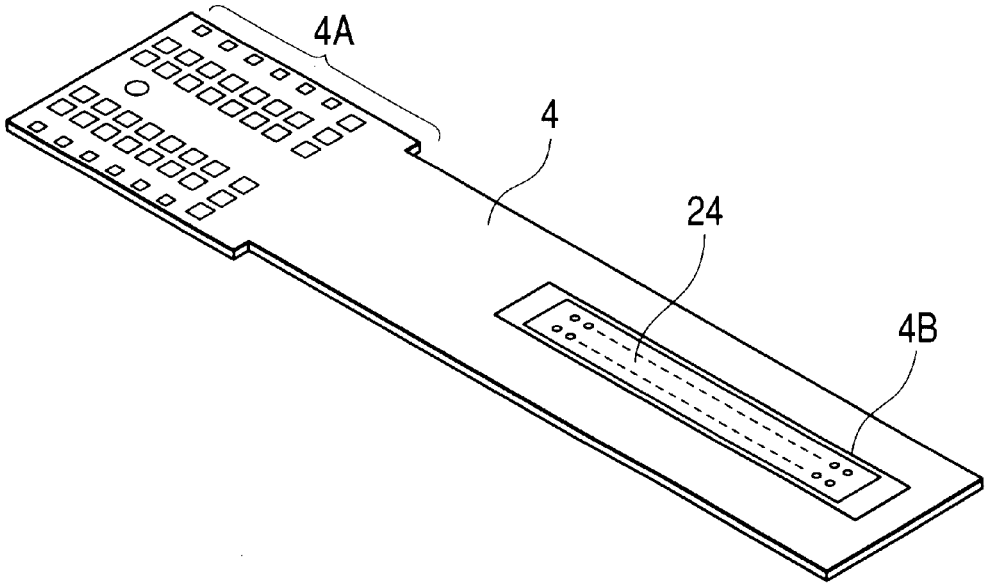
FIG. 11 is a view that shows the conventional recording element base plate and printed circuit board.

To the recording element base plate 2, the driving control signal group is supplied through the input terminal portion 1*b* by means of a printed circuit board (not shown). The inner structure of the recording element base plate 2 is the same as that of the recording element base plate to be shown in FIG. 10. Therefore, the description thereof will be omitted. The recording element base plate 2 is formed by silicon material in a thickness of 0.5 to 1.0 mm. On the bonding surface A' side, the connecting member 3 is bonded thereto, and there is arranged the ink supply opening portion 54 (see FIG. 2A), which extends in the arrangement direction of the ink discharge ports 51. Here, a reference numeral 53 designates the discharge port array.

For the ink supply portion 1*a* of the main body portion 1, the liquid chamber 1*d*, which is recessed substantially in a rectangular form, is provided. Almost on the center of the liquid chamber 1*d*, the thin and long opening portion is arranged for inducing ink from an ink-retaining portion (not shown), and a filter 1*e* is arranged thereon to remove dust particles in the ink. Further, for the liquid chamber 1*d*, a recording element supporting portion 1*c* is provided to connect the main body portion 1 and the recording element base plate 2 directly. With the direct connection between the recording element supporting portion 1*c* and the connecting member 3, it becomes possible to maintain the position of the recording element base plate 2 in high precision.

The bonding surface B of the connecting member 3 is bonded to the bonding surface B' of the main body portion 1. Also, the bonding surface A of the connecting member 3 is bonded to the bonding surface A' of the recording element base plate 2. Each of the bonding areas 55 which is actually bonded, as shown in FIG. 2A, is part of bonding surfaces A, A' and bonding surfaces B, B', respectively, and each of them shifts horizontally. On the center of the connecting member 3, there is open the ink supply port 52 as a communication port, through which ink is supplied from the liquid chamber 1*d* to the ink supply opening portion 54 of the recording head.

The connecting member 3 is formed by resin, such as polyimide, in a thickness of as thin as approximately 0.5 mm, for example, having a stretching strength that is weaker than that of the recording element base plate 2. Polyimide is soft and has resistance to heat, but is not easily affected by the ink component. Therefore, it is particularly suitable for the connecting member 3. In this respect, however, the material of this member is not limited to resin. It may be possible to use thin metal, such as SUS or a compound material of metal and resin, such as a multiple layered laminate material of aluminum (Al) and resin. If metal is used, the gas barrier capability is enhanced to make it possible to suppress the ink evaporation to an extremely low level. However, the range of selection of the kinds of metal, which is not easily affected by the ink component, and not dissolved to cause burning either, is limited. In addition, metal has a comparatively strong starching capability even in a small thickness, thus presenting the disadvantage that the recording element base plate tends to be deformed easily. In contrast, a compound material of resin and metal has a multiple layered structure having a thin metal plate or a metal deposition film sandwiched with resin. Thus, the metal is not directly in contact with the ink component. It is not affected by ink and it does not cause burning either. Furthermore, the sandwiched metallic film suppresses ink evaporation. Therefore, this structure is particularly suitable for the purpose.

Also, the connecting member is good enough if it has a stretching strength weaker than that of the recording element base plate, and preferably, it satisfies the following relationship:

$$Es \cdot ts^3 \cdot ws > Ea \cdot ta^3 \cdot wa \quad \text{(i)}$$

where

Es: Young's modulus (dyn/cm$^2$) of the recording element base plate ts: thickness (cm) of the recording element base plate ws: width (cm) of the recording element base plate Ea: Young's modulus (dyn/cm$^2$) of the connecting member ta: thickness (cm) of the connecting member wa: width of the connecting member (cm)

With the structure thus arranged, the recording element base plate, the connecting member, the supporting member, and the ink supply member are bonded by use of a thermal curing bonding agent. Then, since the curing temperature is higher than room temperature, each of the members is bonded in a state of being expanded. After bonding, as the head temperature is lowered, each of the members is contracted. Usually, the supporting member and the ink supply member are formed from resin, and the linear expansion coefficient thereof is larger than that of the recording element base plate. Also, if resin is used for the connecting member, too, the linear expansion coefficient thereof becomes larger than that of the recording element base plate. As a result, the ratio of contraction is different in the recording element base plate and other members when the head temperature is lowered after bonding, and this difference results in dimensional changes. However, as described above, with the connecting member, the stretching strength of which is made weaker than that of the recording element base plate, the stresses exerted by the aforesaid thermal changes are absorbed by the deformation of the connecting member to make it possible to reduce the adverse effect on the recording element base plate. In this manner, it is possible to minimize the thermal influence on the recording head when using a thermal curing bonding agent.

Further, as has been described in the present embodiment, with the structure in which the bonding portion A A' of the recording element base plate and the connecting member and the bonding surface B B' of the connecting member and the main body portion shift in the horizontal direction (the axes thereof shift), while the stretching strength of the connecting member is made weaker than that of the recording element base plate, the stresses exerted by the difference in the dimensional changes between the recording element base plate and other members are absorbed by the deformation of the connecting member disposed between the bonding portion A A' and the bonding portion B B'. Then, there is almost no influence exerted on the recording element base plate due to the aforesaid heat and stresses.

The absorption of stresses by the deformation of the connecting member between the bonding portions that shift as described above makes the amount of deformation significantly larger than that of the structure in which a recording element base plate and a main body portion are bonded directly by use of a soft bonding agent or resin, and the structure of the present ink jet recording head is excellent in the aspect of stress absorption effect.

As a result, by the adoption of the structure hereof, it is possible to execute the head assembling with almost no deformation of the recording element base plate even if the number of nozzles increases to make the length of the recording element base plate larger (particularly effective for the recording element base plate having a length of one inch or more, for example).

Also, with the direct bonding of the recording element supporting portions 1*c* at the edges of the recording element base plate as shown in FIG. 1 and FIGS. 2A and 2B, the present embodiment provides the structure whereby the positional precision on the central area near the discharge ports is retained, while absorbing stresses on the circumference thereof. As a result, it is made possible to perform high-quality printing.

Also, the structure hereof is able to produce the same effects against the generation of stresses due to the difference in the expansion coefficient of each member, which is brought about by the temperature rise of the head during printing operation in the case where the recording element base plate, the connecting member, the supporting member, and the ink supply member are bonded by use of a cold (room temperature) curing bonding agent.

In other words, each of the members expands when the head temperature rises during printing operation such that the dimensions thereof increase. Usually, the supporting member and the ink supply member are formed of resin. Therefore, their linear expansion coefficients thereof are larger than that of the recording element base plate. Also, if the connecting member is formed of resin, the linear expansion coefficient thereof becomes larger than that of the recording element base plate. As a result, when the temperature rises during printing operation, a difference between dimensional changes ensues due to the difference between the expansion coefficient of the recording element base plate and those of other members.

However, as described above, with the connecting member the stretching strength of which is made weaker than that of the recording element base plate, it is possible to absorb the stresses exerted by the aforesaid thermal changes by means of deformation of the connecting member, so as to reduce any possible influence that may be given to the recording element base plate.

Further, in the embodiment described above, the bonding portion A A' between the recording element base plate and the connecting member and the bonding surface B B' between the connecting member and the main body portion are structured to shift in the horizontal direction (shift axes), and the stretching strength of the connecting member is made weaker than that of the recording element base plate. In this way, the stresses that should be exerted due to the difference in the dimensional change of the recording element base plate and those of other members are absorbed by the deformation of the connecting member disposed between the bonding portion A A' and the bonding portion B B'. As a result, there occurs almost no influence of heat and stresses given to the recording element base plate.

Therefore, with the provision of the structure hereof, it is possible to execute the head assembling with almost no deformation of the recording element base plate even when the number of nozzles increases so that the length of the recording element base plate is made large (particularly effective for the recording element base plate of one inch or more, for example).

Second Embodiment

Figure 3:
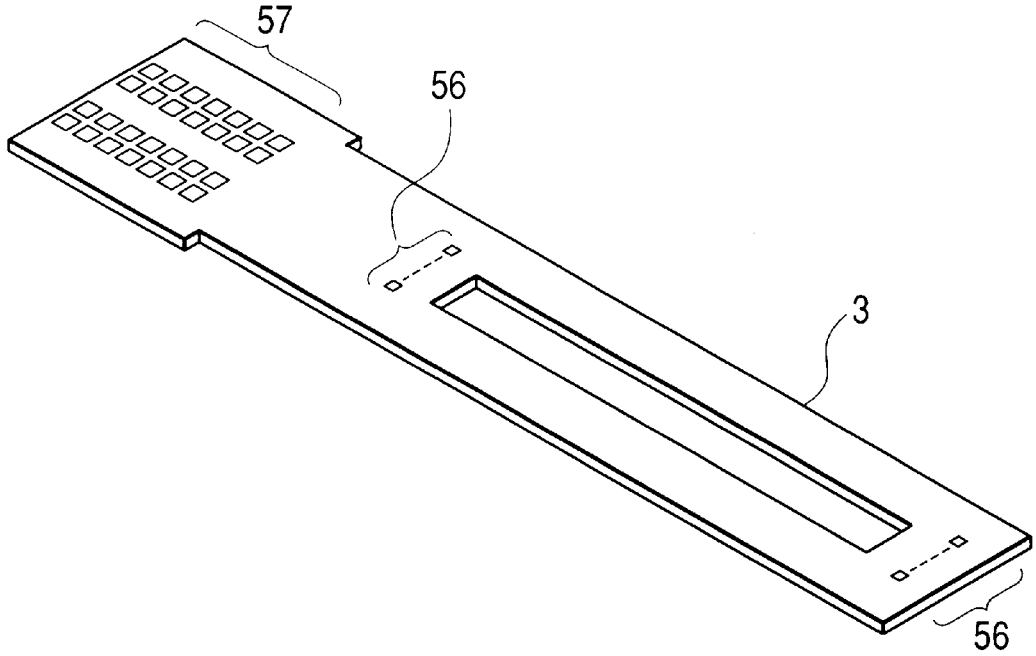
FIG. 3 is a view that shows the structure of a second embodiment in accordance with the present invention.
Figure 4:
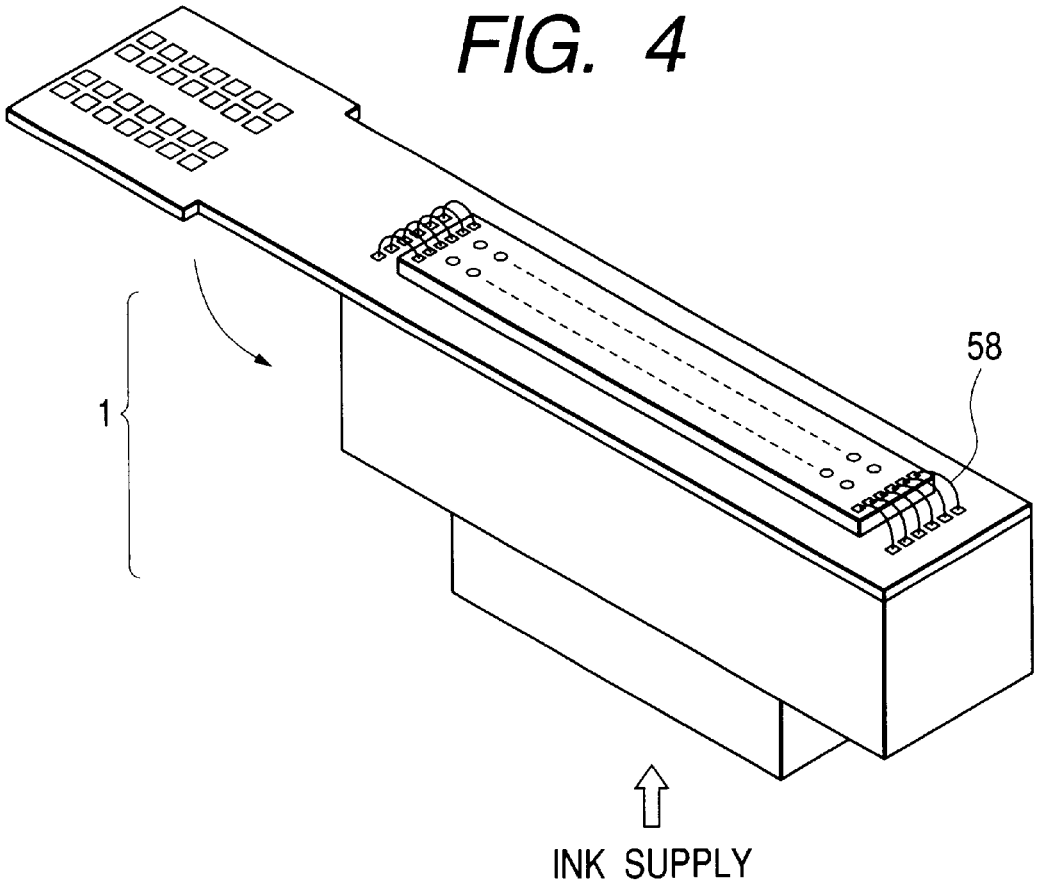
FIG. 4 is a view that shows the structure of the second embodiment in accordance with the present invention.

FIG. 3 and FIG. 4 are views that illustrate the structure of a second embodiment of the present invention.

For the present embodiment, the structure is arranged so that the connecting member 3 also serves as a printed circuit board that supplies a driving control signal group to the recording element base plate.

The structure is such that the electrodes of the connecting member 3 are laminated by resin, and that the carriage electrode-contacting portion 57, which electrically connects the carriage with the electrode pads 56 electrically connected with the recording element base plate, is exposed on the resin layer. As shown in FIG. 4, the electrodes 58 of the connecting member 3 are wired to the electrode pads of the connecting member from the recording element base plate by means of wire bonders or the like installed on the main body portion.

The carriage electrode-contacting portion is installed on the sidewall of the main body portion by being folded in the direction indicated by the arrow in FIG. 4.

In accordance with the present embodiment, it becomes unnecessary to prepare the printed circuit board that supplies the driving control signal group to the recording element base plate as a separate component, thus making cost reduction possible, while providing the same advantages as the first embodiment.

Third Embodiment

Figure 5:
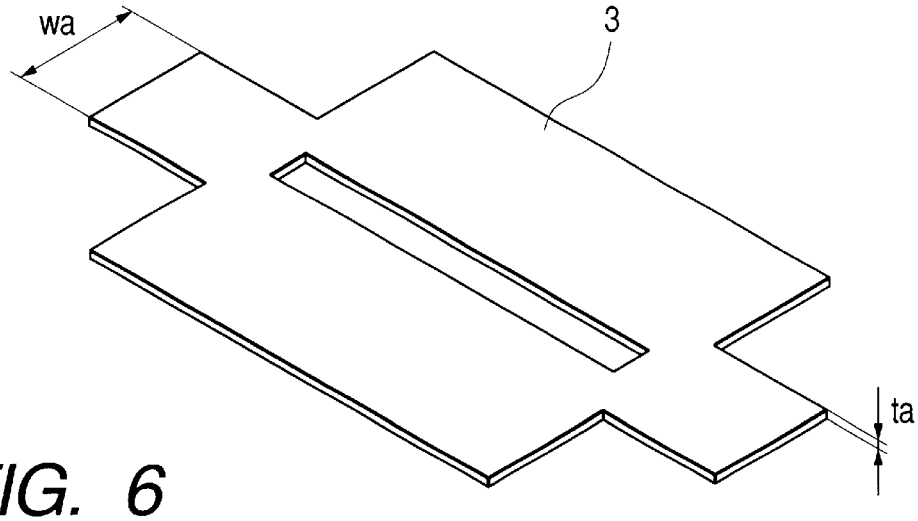
FIG. 5 is a view that shows the structure of a third embodiment in accordance with the present invention.
Figure 6:
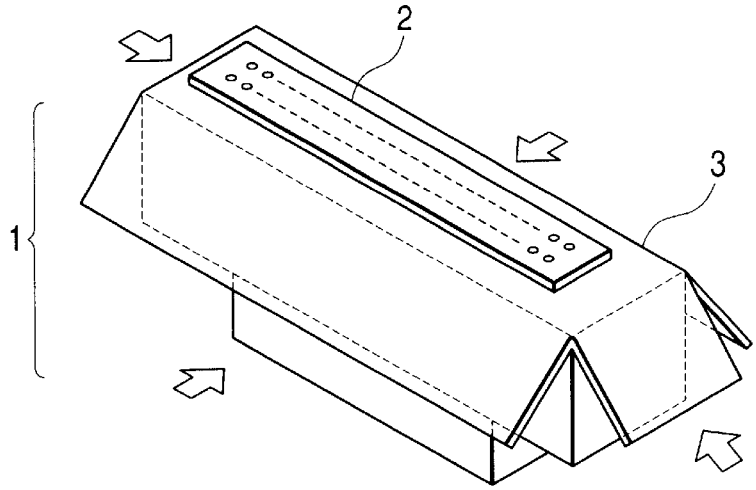
FIG. 6 is a view that shows the structure of the third embodiment in accordance with the present invention.
Figure 7:
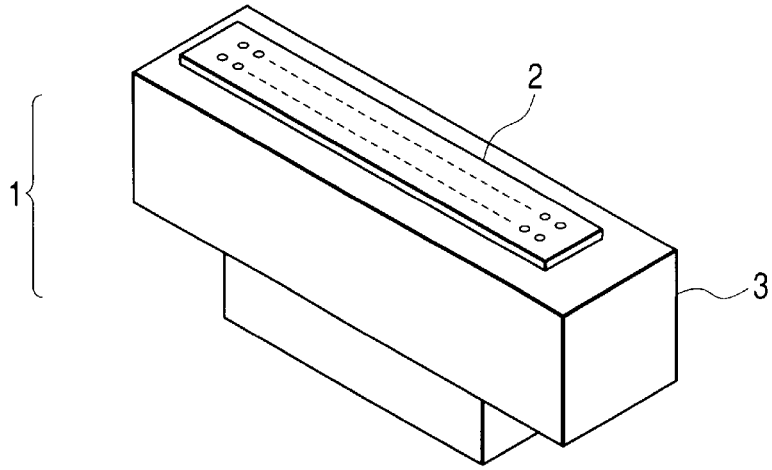
FIG. 7 is a view that shows the structure of the third embodiment in accordance with the present invention.
Figure 8:
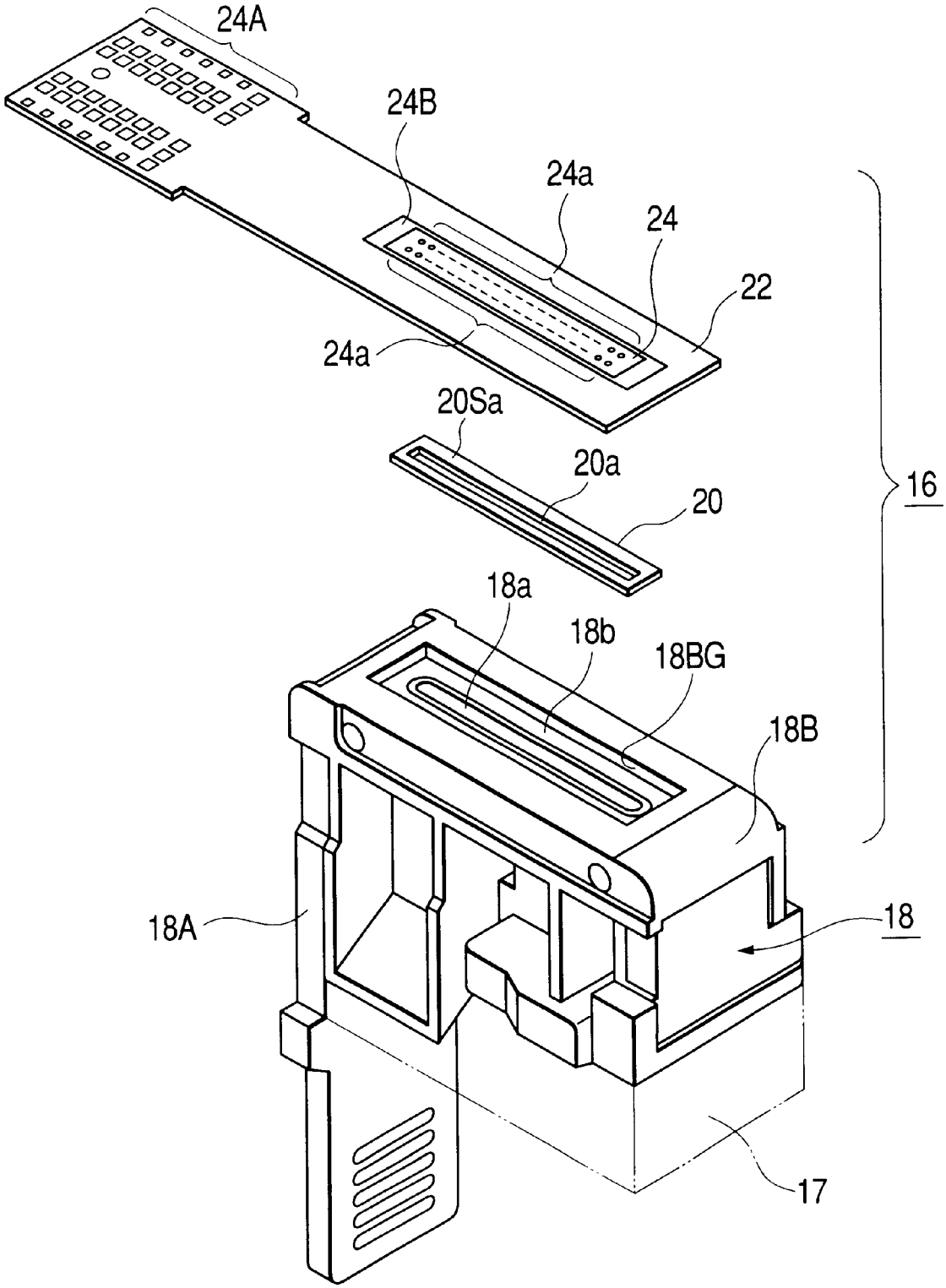
FIG. 8 is a view that shows the structure of the conventional ink jet recording head.
Figure 9A:
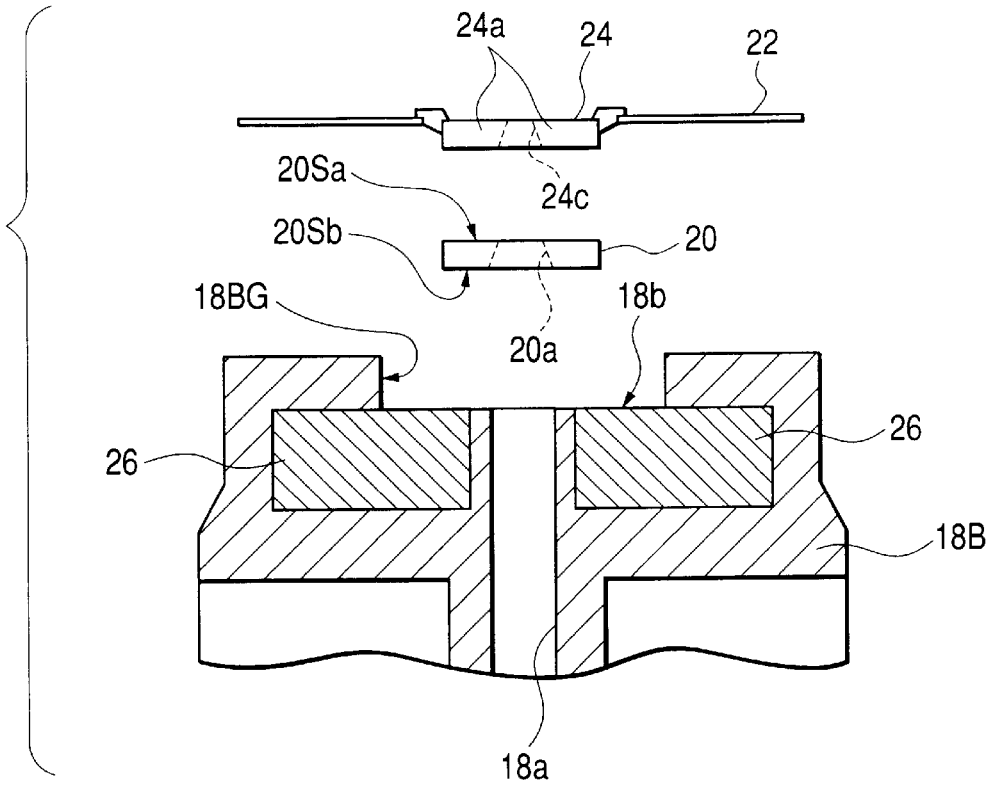
FIGS. 9A and 9B are views that illustrate the structure of the conventional example.
Figure 9B:
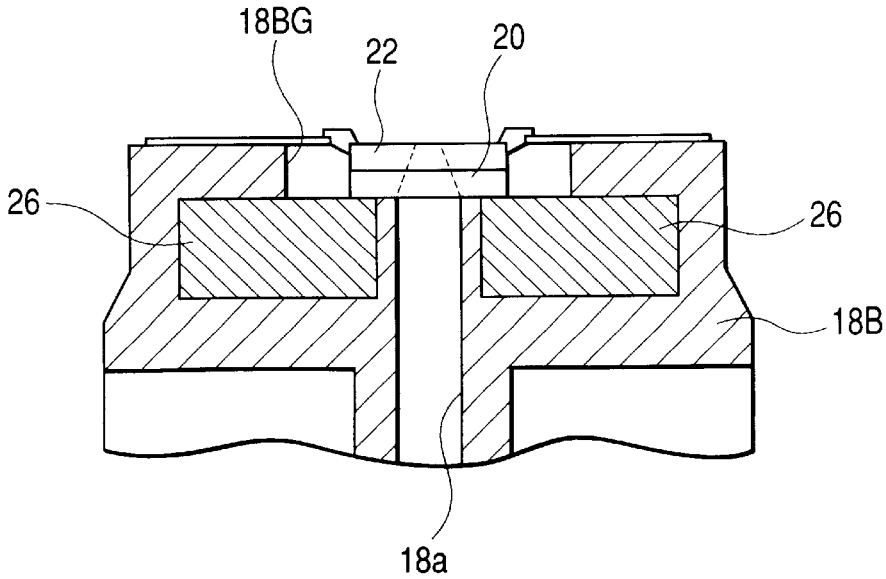

FIG. 5, FIG. 6, and FIG. 7 are views that illustrate a third embodiment of the present invention.

For the present embodiment, the structure is arranged so that the connecting member 3 has an area larger than the cross-sectional area of the main body portion 1, and so that the connecting member 3 also serves as a heat-radiating portion. As shown in FIG. 6, the connecting member that projects outward from the main body is bent in the directions indicated by arrows, and installed on the side faces as shown in FIG. 7.

The connecting member is formed by metallic material, resin-laminated metal, or metal laminated with resin only on the area which contacts ink and the heat-radiating portion of the connecting member is metal exposed for this purpose.

In accordance with the present embodiment, the temperature of the recording element base plate does not easily rise, because heat generated by the recording element base plate during printing can be effectively radiated externally through the connecting member. Furthermore, the amount of deformation of the recording element base plate is made smaller.

What is claimed is:

1. An ink jet recording head comprising:

a recording element base plate having an ink heating portion for heating ink, and ink discharge ports for discharging ink;

a main body portion having an ink supply path for inducing ink from an ink retaining portion; and a connecting member having a first bonding surface bonded to said main body portion, and a second bonding surface bonded to said recording element base plate, wherein said connecting member is formed by material having a weaker stretching strength than that of said recording element base plate.

2. An ink jet recording head according to claim 1, wherein the relationship between said connecting member and said recording element base plate is arranged to satisfy the following formula (i):

$$Es \cdot ts^3 \cdot ws > Ea \cdot ta^3 \cdot wa \quad \text{(i)}$$

where

Es: Young's modulus (dyn/cm$^2$) of the recording element base plate ts: thickness (cm) of the recording element base plate ws: width (cm) of the recording element base plate Ea: Young's modulus (dyn/cm$^2$) of the connecting member ta: thickness (cm) of the connecting member wa: width of the connecting member (cm).

3. An ink jet recording head according to claim 1, wherein said connecting member is formed from either resin or a compound material of resin and metal.

4. An ink jet recording head according to claim 1, wherein said connecting member is formed from polyimide.

5. An ink jet recording head according to claim 1, wherein said connecting member is provided with electrode wiring for use in driving heat generating elements of said recording element base plate.

6. An ink jet recording head according to claim 1, wherein said connecting member is structured to laminate an electrode wiring with resin.

7. An ink jet recording head according to claim 1, wherein said recording element base plate and said main body portion are each provided with a portion for bonding said recording element base plate and said main body portion directly to each other.

8. An ink jet recording head according to claim 7, wherein said portions of direct bonding of said recording element base plate and of said main body portion are arranged at plural locations.

9. An ink jet recording head according to claim 1, wherein the bonding center of said first bonding surface and the bonding center of said second bonding surface are arranged to shift in the horizontal direction.

10. An ink jet recording head according to claim 9, wherein an area of direct bonding between said recording element base plate and said main body portion, said second bonding surface, and said first bonding surface are arranged in that order from a central area of said main body portion to a periphery of said main body portion.

* * * * *